United States Patent [19]

DeJong

[11] 4,401,109

[45] Aug. 30, 1983

[54] VIBRATORY MASSAGE DEVICE

[75] Inventor: Peter G. DeJong, Grand Rapids, Mich.

[73] Assignee: General International Corporation, Glenview, Ill.

[21] Appl. No.: 248,952

[22] Filed: Mar. 30, 1981

[51] Int. Cl.[3] ..... A61H 1/00

[52] U.S. Cl. ..... 128/41

[58] Field of Search ..... 128/41, 42, 51, 52, 128/32; 335/261, 258, 297, 281

[56] References Cited

U.S. PATENT DOCUMENTS

| | | | |
|---|---|---|---|
| 1,234,700 | 7/1917 | McLain | 128/41 |
| 3,103,925 | 9/1963 | Vogt | 128/41 |
| 3,168,242 | 2/1965 | Deiner | 335/261 |

FOREIGN PATENT DOCUMENTS

| | | | |
|---|---|---|---|
| 1425938 | 2/1976 | United Kingdom | 128/41 |

*Primary Examiner*—Richard J. Apley

*Assistant Examiner*—David J. Brown

*Attorney, Agent, or Firm*—Charles F. Pigott, Jr.

[57] ABSTRACT

A vibratory massage device comprising a casing, a flat spring member which carries magnetically attractable masses adjacent opposed ends thereof, and electromagnetic means for vibrating the spring member and masses. By the improvement of this invention electromagnetic means comprising an integral core piece having a pair of parallel arms is provided, with surrounding electric coil means, with the parallel arms defining free ends generally V-shaped in cross section. The magnetically attractable masses include mating members positioned to magnetically interact with the free ends, and of a shape to fit in mating relation with the free ends. As the result of this, upon actuation of the electric coil means to create a pulsating magnetic field in the parallel arms, the spring member and masses are subjected to a pulsating magnetic force of improved strength for improved vibratory movement into and out of the mating relation.

5 Claims, 6 Drawing Figures

Fig. 1.
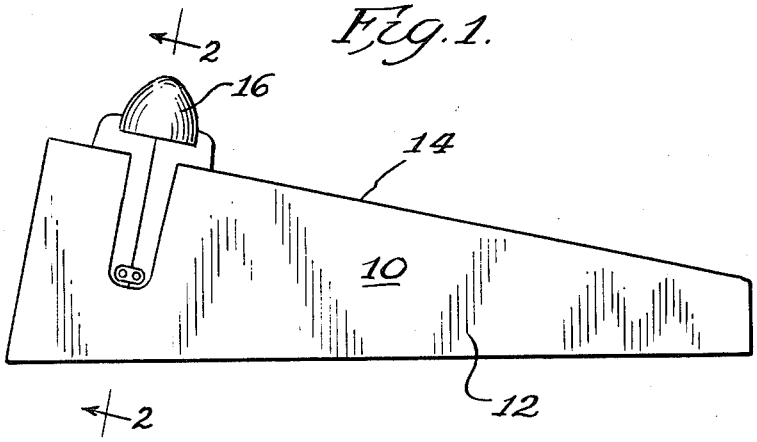
Fig. 2.
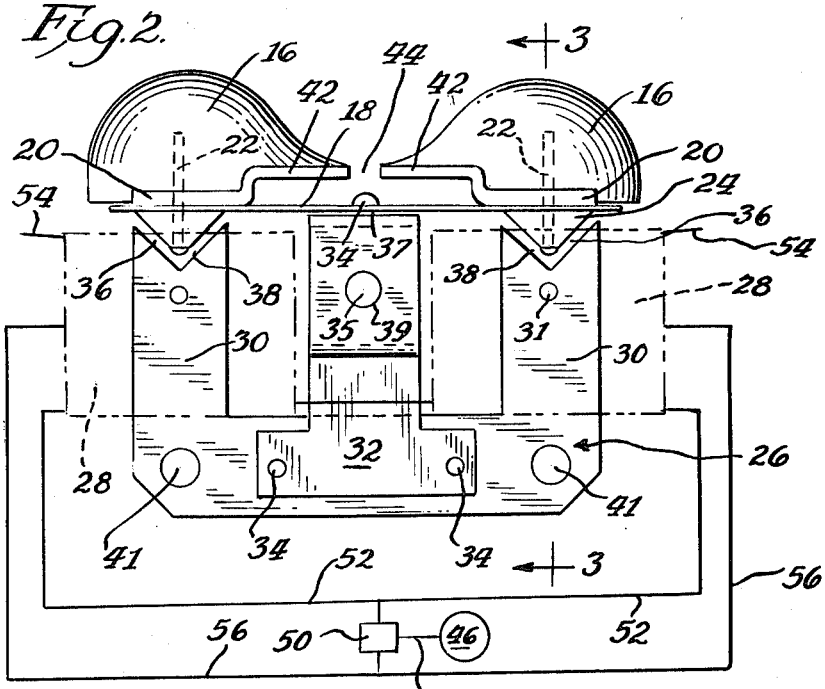
Fig. 3.
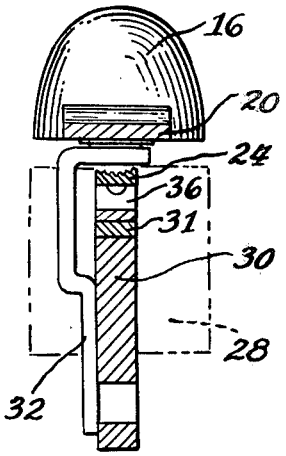
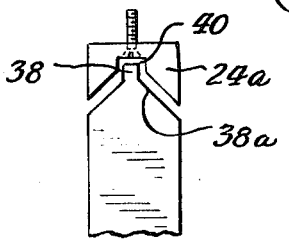
Fig. 4a.
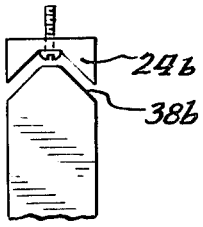
Fig. 4b.
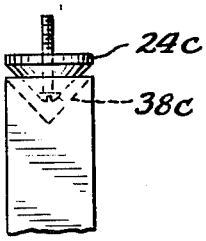
Fig. 4c.

VIBRATORY MASSAGE DEVICE

BACKGROUND OF THE INVENTION

Vogt U.S. Pat. No. 3,103,925 discloses a massage device having spaced massage heads that vibrate relative to each other, to produce individual areas of vibration at each head and a kneading action between the two heads.

By this invention, an improved massage device of broadly similar overall design is provided, of greater power efficiency, and having an optimized heat rise versus performance, having high uniformity of performance in the production units.

Also, the structure of this application is capable of exhibiting two-speed operation, resulting in an energy saving unit which provides better performance to the units of the prior art.

DESCRIPTION OF THE INVENTION

In this invention the vibratory massage device is provided comprising a casing, a flat spring member which carries magnetically attractable masses adjacent the opposed ends thereof, and electromagnetic means for vibrating the spring member and masses.

In accordance with this invention, the electromagnetic means comprises an integral core piece having a pair of parallel arms and surrounded by electric coil means, with the parallel arms defining free ends which are generally V-shaped in cross section. The magnetically attractable masses include mating members positioned to magnetically interact with the free ends, and of a shape to fit in mating relation with the free ends. Improved magnetic interaction between the parallel arms, which serve as pole pieces for electromagnetic coils, and the flat spring member with its mating members is provided, so that a higher efficiency of operation becomes available.

Upon actuation of the electric coil means to create a pulsating magnetic field in the parallel arms, the spring member and masses are subjected to a pulsating magnetic force, which circuit typically extends in a single-loop path of improved strength, when compared with the prior art, for improved vibratory movement into and out of the mating relation.

Preferably, the integral core piece is of U-shape, with the electric coil means comprising a pair of separate, electrically connected coils, each mounted on a separate, parallel arm of the core piece.

The U-shaped core piece may carry a structural member positioned between the parallel arms, attached to and carrying the spring member at a central position thereof. The structural member is substantially a non-participant in the pulsating magnetic circuit, it being generally preferred to minimize the magnetic circuit in the structural member. For example, the structural member may, if desired, be made of a nonmagnetic material, or, if it is of a magnetic material, it is preferably of significantly less thickness than the parallel arms, to minimize the overall magnetic flux of the structural member.

The magnetically attractable masses may each include ferromagnetic plate members carried on the flat spring member. The plate members may have ends which extend into closely spaced proximity to each other to strengthen the magnetic circuit extending between them, with a spacing typically being only that amount which is necessary to accommodate the vibratory motion of the respective magnetically attractable masses.

The plate members may each define a stepped portion to increase the air gap between the stepped portions and the top of the structural member, particularly in the case where the structural member is made of a ferromagnetic material, to reduce the overall magnetic flux through the structural member.

Each electric coil, positioned on an arm of the U-shaped core piece, may define an extra electric connection at a point spaced between the ends of the wire of the coil. Switch means are provided for passing electric current through the entire length of wire in the coil, or alternatively only part of the length of the wire through an extra electric connection, for providing differing magnetic field strengths and correspondingly differing vibration characteristics to the device, depending upon the position of the switch.

Accordingly, upon intermittent magnetic actuation of the core piece to provide a pulsating magnetic field, the magnetically attractable masses are pulled toward the arm ends with improved force and efficiency because of the V-shaped relationship of the respective ends of the parallel arms and mating members, providing propagation of an overall stronger magnetic force between the two members. When the pulsating magnetic field is in a reduced phase, the spring member tends to spring back to its flat position, in which desirably the mating members are spaced from the free ends. It also may be desirable to select a frequency of pulsation of the magnetic field that tends to reinforce the natural period of vibration of the spring member, rather than a rate of pulsation which interferes with the natural oscillation rate of the spring member, so that improved oscillation is provided. It may also be desirable to select the natural period of vibration of the spring and mass members, by proper design, to be at or near the frequency of the pulsating magnetic field, if this frequency is fixed, so that improved oscillation is achieved.

In the drawings, FIG. 1 is an elevational view of the vibratory massage device of this invention.

FIG. 2 is a sectional view taken along line 2—2 of FIG. 1, with some circuitry shown schematically and the electric coils shown in phantom lines, and the housing omitted.

FIG. 3 is a sectional view taken along line 3—3 of FIG. 2 with a coil shown in phantom lines.

FIGS. 4*a, b* and *c* are detailed elevational views of various embodiments of ends of the parallel arms and their corresponding mating members.

Referring to the drawings, massage device 10 includes a housing 12 with an upper surface 14 comprising a foot rest, and a pair of bulbous head members 16 on which, and between which, the feet may be placed. Head members 16 may be made of a nonmagnetic alloy, for example a die cast zinc alloy, and are bolted as shown to metallic, flat spring member 18. Head members 16 rest on ferromagnetic plate members 20, with the same bolt 22 holding members 16, 20 and a ferromagnetic mating member 24, shown to be a wedge-shaped plate.

C-shaped integral core piece 126 may be of conventional design, and carries a pair of electromagnetic coils 28 on each of its parallel arms 30.

Accordingly, upon actuation of the coils, a magnetic circuit is provided in a loop extending through each of the arms 30, wedges 24, plates 20, and the bottom of core piece 26.

Rivets 31 may be used to hold the laminations of core piece 26 together, if a laminated type is used.

U-shaped core piece 26 may carry structural member 32, which is specifically shown to be in the shape of an inverted T, being attached by rivets 34 to core piece 26. Structural member 32 may be of a nonmagnetic material, if desired, or if it is of a ferromagnetic material, it is preferably substantially thinner than core piece 26 and its arms 30, as specifically shown in FIG. 3.

Structural member 32 secures spring member 18 to its top by a bolt 34 or the like, to properly position the spring member with the desired air gap 36 between mating members 24 and the ends 38 of each arm 30. Projection 37 serves to help hold spring member 18 in position. Aperture 39 in member 32 receives a stud 35 carried on the inner wall of housing 12, to cooperate with studs 41, also on the inner wall, extending through corresponding apertures to retain core piece 26 in the desired position.

In accordance with this invention, the free ends 38 of arms 30 are of generally V-shaped cross section as shown in FIG. 2, with mating members 24 and ends 38 being proportioned to fit in mating relation with each other. A strengthened magnetic force across air gap 36 is provided thereby.

As shown in FIGS. 4*a*, 4*b*, and 4*c*, different shapes for ends 38*a*, 38*b*, and 38*c* are disclosed, being analogous to ends 38 in FIG. 2. Mating members 24*a*, *b*, and *c* are proportioned to provide correspondingly mating contact with ends 38*a* through c. As shown, the ends occupy inverted V-shaped cross sections, with the end 38*a* of FIG. 4*a* defining a protrusion 38 and a corresponding recess 40 in mating member 24*a*. The structure of FIG. 4*b* is also roughly in the shape of an inverted V, while the conical end 38*c* is fitted with a conical mating member 24*c*. All of the above structures are, of course, generally V-shaped in their cross section, and provide the improved magnetic efficiency for oscillation of spring 18.

Each of plate members 20 may define a stepped portion 42 to increase the air gap between the stepped portions 42 and the top of the structural member 32, i.e., bolt 34. This is particularly desirable when structural member 32 is made of a magnetic material, so that magnetic force can be bled off through the structural member, away from the desired single loop path. As stated previously, air gap 44 between the ends of plates 20 is preferably minimized, but is desirably present to permit free oscillatory motion of members 16. Little magnetic flux is carried by spring 18, if it is as thin as shown.

In the operation of the device of this invention, a source 46 of pulsed direct current or alternating current passes through line 48 to switch 50. Selectively, the pulsed current can pass through line 52 to one end each of coils 28, passing the entire length of the wound wire of the coils, and exiting to ground line 54 or another conventional line for completing the circuit.

At the other position of switch 50, current passes through line 56 to connect with each coil 28 at a point spaced between the ends of the wire of the coil, so that only a part of each coil operates, to provide a pulsating electromagnetic field of greater intensity for stronger operation of the device.

Heads 16 may be covered with a soft material if desired, and conventional power circuitry may be utilized to effect the desired pulsed or alternating electric current to the device of this invention, which can operate at increased power efficiency for improved action, without generation of excessive heat for draining excessive power.

The above has been offered for illustrative purposes only, and is not intended to limit the scope of the invention of this application, which is as defined in the claims below.

That which is claimed is:

1. In a vibratory massage device comprising a casing, a flat spring member which carries magnetically attractable masses adjacent opposed ends thereof, and electromagnetic means for said vibrating spring member and masses, the improvement comprising, in combination:

said electromagnetic means comprising an integral core piece having a pair of parallel arms and being of generally U-shape, and a pair of electrically connected coils, each coil being mounted on separate, parallel arms, said parallel arms defining free ends generally V-shaped in cross section, said magnetically attractable masses including mating members positioned to magnetically interact with said free ends and of a shape to fit in mating relation with said free ends, said U-shaped core piece carrying a structural member positioned between the parallel arms, said structural member being attached to and carrying said spring member at a central position thereof, said structural member being substantially a non-participant in the pulsating magnetic circuit, and of less thickness than the parallel arms, said magnetically attractable masses each including ferromagnetic plate members carried on said flat spring member, said plate members extending ends into closely spaced proximity to each other to strengthen the magnetic circuit extending between them, each plate member defining a step portion to increase the air gap between the step portions and the top of the structural member.

2. The massage device of claim 1 in which said structural member is made of a nonmagnetic material.

3. The massage device of claim 1 in which each electric coil means defines an extra electric connection at a point spaced between the ends of the wire of the coil, and switch means for alternatively passing electric current through the entire length of wire in the coil, or only part of the length of said wire through said extra electric connection, for providing differing magnetic field strengths and vibration characteristics.

4. In a vibratory massage device comprising a casing, a flat spring member which carries magnetically attractable masses adjacent opposed ends thereof, and electromagnetic means for vibrating said spring member and masses, the improvement comprising, in combination:

said electromagnetic means comprising an integral core piece of generally U-shape with parallel arms, and separate electric coils mounted on each separate parallel arm and electrically connected together, said U-shaped core piece carrying a structural member positioned between said parallel arms, said structural member being attached to and carrying said spring member at a central position thereof, said structural member being substantially a non-participant in the pulsating magnetic circuit, and of less thickness than said parallel arms, said magnetically attractable masses each including ferromagnetic plate members carried on said flat spring member, said plate members extending into closely spaced proximity to each other to strengthen the magnetic circuit extending between them.

5. The massage device of claim 4 in which said plate members each define a stepped portion to increase the air gap between the stepped portions and the top of the structural member.

* * * * *